United States Patent [19]

Hilton

[11] Patent Number: 4,964,797

[45] Date of Patent: Oct. 23, 1990

[54] CATALYTIC HEATER FOR INTERNAL COMBUSTION ENGINES

[76] Inventor: Chester W. Hilton, 2133 Big Lake Rd., Cloquet, Minn. 55720

[21] Appl. No.: 231,364

[22] Filed: Aug. 12, 1988

[51] Int. Cl.[5] ..... F23D 14/18

[52] U.S. Cl. ..... 431/328; 431/326; 431/154; 431/259; 126/350 A; 237/12.3 C

[58] Field of Search ..... 126/85 R, 93, 94, 95, 126/96, 97, 358, 350 R, 258, 350 A, 351, 92 C; 431/326, 328, 329, 154, 259; 123/41.14, 142.5 R; 237/12.3 C

[56] References Cited

U.S. PATENT DOCUMENTS

| | | | |
|---|---|---|---|
| 1,053,695 | 2/1913 | Ash | 126/85 R |
| 1,178,433 | 4/1916 | Wight . | |
| 1,363,880 | 12/1920 | King . | |
| 1,857,767 | 5/1932 | Rentz | 126/350 A |
| 1,871,008 | 3/1933 | Rentz . | |
| 2,074,168 | 3/1937 | Danuser et al. . | |
| 2,289,533 | 7/1942 | Trca | 126/93 |
| 2,556,804 | 6/1951 | Fagan . | |
| 3,277,886 | 10/1966 | Ryals et al. | 123/142.5 R X |
| 3,343,586 | 9/1967 | Berchtold et al. | 126/96 X |
| 3,400,700 | 9/1968 | Lindsey et al. | 126/350 A X |
| 3,485,230 | 12/1969 | Harrington et al. | 431/329 X |
| 3,501,257 | 3/1970 | Hilton et al. . | |
| 3,733,170 | 5/1973 | Kobayashi et al. | 431/329 |
| 3,796,207 | 3/1974 | Olson . | |
| 3,901,213 | 8/1975 | Charboneau | 126/350 A |
| 4,381,742 | 5/1983 | Funk . | |
| 4,706,644 | 11/1987 | Nakai . | |

*Primary Examiner*—Carl D. Price

*Attorney, Agent, or Firm*—Peterson, Wicks, Nemer & Kamrath

[57] ABSTRACT

The heater includes a jacket unit connectable to the cooling system of an internal combustion engine, the jacket unit forming a central cavity in which a catalytic burner unit is suspended by means of a bolt that extends upwardly through an upper opening in the jacket unit. Overlying the jacket unit is a perforated dome-shaped cap having a hole through which the bolt extends so that a nut applied to the upper end of the bolt clamps the perforated cap against the upper end of the jacket unit, at the same time suspending the burner unit within the jacket unit's cavity. Within the cavity is a fixedly positioned ring through which the bolt extends, the bolt having a collar that abutts the underside of the ring when the nut is fully tightened. The catalytic burner unit also includes a feed tube extending downwardly therefrom. A second perforated dome-shaped cap underlies the jacket unit having a hole through which the feed tube extends. A sleeve of catalytic material is included in the burner unit. In one instance a glow plug is employed to initially ignite the fuel supplied through the feed tube and in a second instance a heating wire is wrapped around the sleeve of catalytic material to initiate the burning action. At the upper end of the feed tube is a wick in one embodiment and a propane nozzle in a second embodiment. Provision is made for attaching the heater to a specially designed portable tank.

14 Claims, 2 Drawing Sheets

CATALYTIC HEATER FOR INTERNAL COMBUSTION ENGINES

BACKGROUND

1. Field of Invention

This invention relates generally to tank heaters for keeping internal combustion engines warm during cold weather, and pertains more particularly to a catalytic heater.

2. Description of the Prior Art

Catalytic heaters for maintaining the cooling systems of internal combustion engines warm during cold weather, particularly those associated with various types of vehicles, is not new. Examples of such heaters are to be found in U.S. Pat. No. 3,796,207, issued on March 12, 1974 to Ellis W. Olson for "Catalytic Tank Heater for Engines" and U.S. Pat. No. 3,501,257, issued on March 17, 1970 to Chester W. Hilton and Walter E. Hebert for "Heater for Automobile Cooling System," the present applicant being one of the patentees in said Pat. No. 3,501,257. Both of the patented heaters possess certain shortcomings that have detracted from their usefulness. Nonetheless, the two patented heaters serve as examples of prior art constructions.

SUMMARY

One object of the present invention is to provide a catalytic heater for internal combustion engines that will be thermally efficient inasmuch as it consumes only small quantities of fuel, whether the fuel be gasoline or propane.

Another object is to provide a catalytic heater that can be easily assembled at the factory and easily disassembled after it has been installed on a vehicle if necessary to do so. In this regard, an aim of the invention is to render my catalytic heater adaptable for use on regular gasoline or propane gas, only a simple substitution of one type of burner for another being necessary.

Also, the invention has an object the provision of a catalytic heater that is compact and lightweight so that it can be readily installed on a vehicle, even where space under the hood is quite limited.

Yet another object of the invention is to provide a catalytic heater that is inexpensive to manufacture, thereby encouraging its widespread use.

Another object is to provide a catalytic heater for vehicles that is safe and reliable.

Still further, an object is to provide a catalytic heater that will not be adversely affected by severe wind conditions that would otherwise extinguish the burner. Actually, a sufficient wind velocity would cause the heater to cycle on and off even though the ambient or atmospheric temperature is such as to require that the heater be continuously energized.

Briefly, my invention envisages two basic units, one being a jacket unit providing a cavity in which the second unit in the form of a catalytic burner is disposed. More specifically, the burner unit has a bolt that extends upwardly through the upper open end of the jacket unit and also through a perforated dome-shaped cap, the upper end of the bolt having a nut attached thereto which holds the perforated cap in place. The catalytic burner unit has a second perforated dome-shaped cap underlying the open bottom of the jacket unit. In one form, the catalytic burner unit makes use of a wick enabling the heater to be operated with gasoline as the fuel, and in another embodiment with a nozzle so that propane gas can be employed as the fuel. The invention contemplates the fuel being ignited by either one or more glow plugs or by means of a heating wire wrapped around the exterior of the burner unit.

These and other more detailed and specific objects will be disclosed in the course of the following specification, reference being had to the accompanying drawings.

DESCRIPTION OF THE PREFERRED EMBODIMENTS

Figure 1:
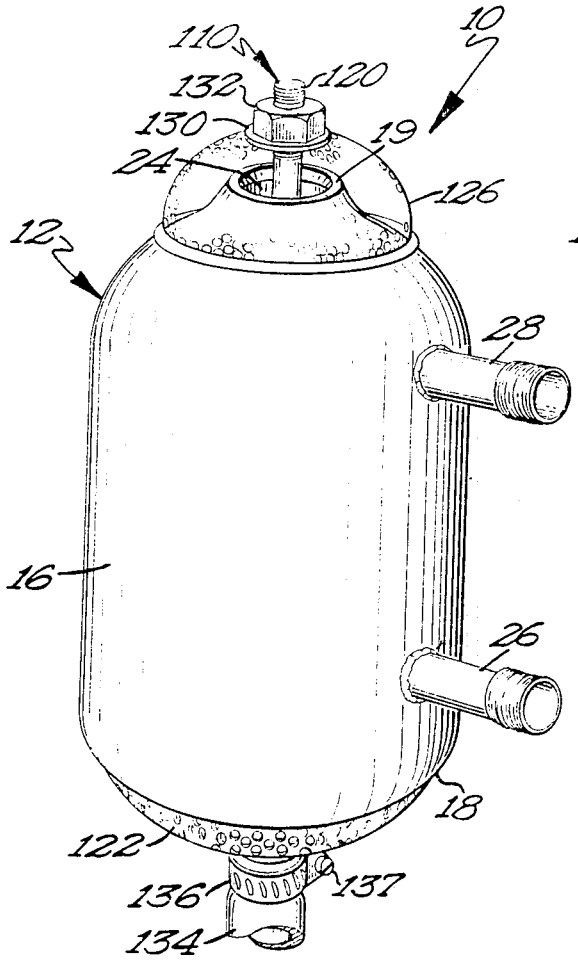
FIG. 1 is a perspective view exemplifying one construction my heater may assume.
Figure 3:
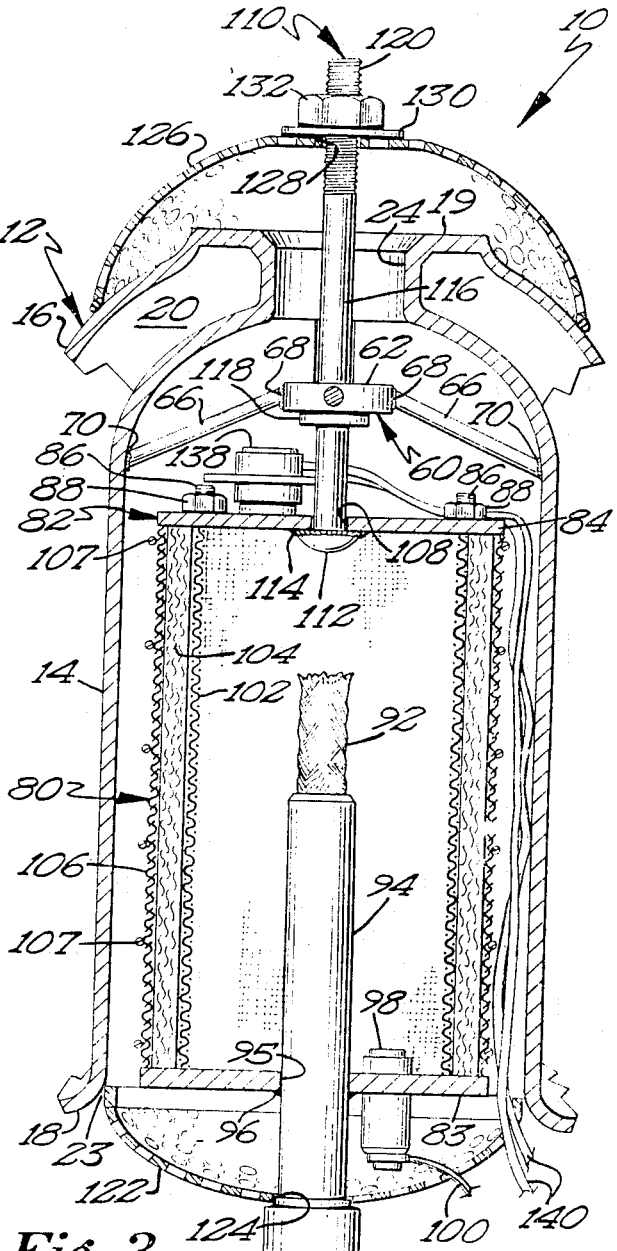
FIG. 3 is a sectional view of the assembled heater.
Figure 2:
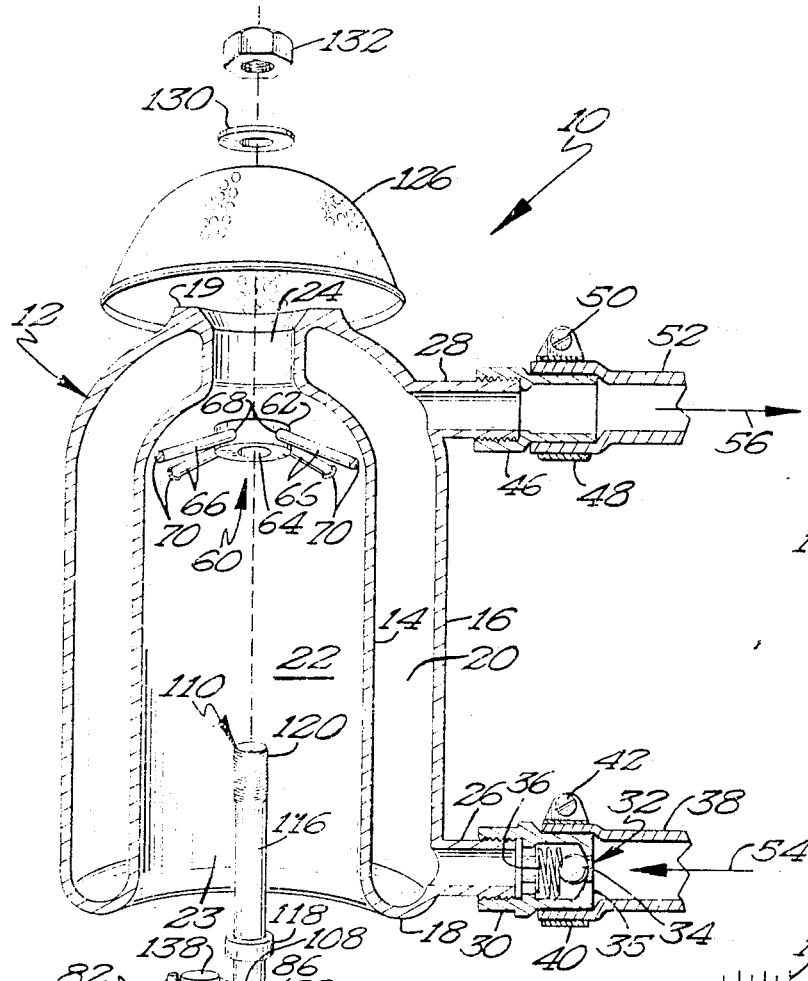
FIG. 2 is an exploded view, partially in section and partially in fragmentary form.

Referring first to FIGS. 1, 2 and 3, the heater shown in these figures has been denoted generally by the reference numeral 10. From FIGS. 2 and 3, it will be observed that the heater 10 includes a heat exchanger in the form of a jacket unit 12 comprised of an inner cylindrical wall 14, an outer cylindrical wall 16, a closed annular bottom 18 and a closed annular top 19, thereby forming an annular chamber 20 through which the engine's cooling liquid flows when practicing the teachings of my invention. It will also be noted, particularly from FIG. 2, that the jacket unit 12 is thus provided with a central cavity 22 having a bottom opening 23 and a top opening 24, the top opening 24 being of lesser diameter than the bottom opening 23; in other words, the top opening 24 is formed by a relatively small tubular neck.

From FIGS. 1 and 3, it will be perceived that there is a lower threaded nipple 26 and an upper threaded nipple 28. Actually, the left ends of the nipples 26, 28 are welded to the outer wall 16. The lower nipple 26 has a coupling 30 threadedly attached thereto which provides a check valve 32 in the form of a shiftable ball 34 that is normally urged against a seat 35 by means of a coil spring 36. A flexible hose 38 is attached to the coupling 30 by means of a conventional hose clamp 40 having a screw 42 via which the clamp is tightened against the hose 38.

Similarly, the upper nipple 28 has a coupling 46 threadedly attached thereto. However, there is no check valve associated with the coupling 46. There is, though, a clamp 48 having a screw 50 that tightens the clamp 48 against one end of a hose 52.

From the foregoing, it should be readily apparent that the lower hose 38 would be connected to the cooling system of an internal combustion engine so that liquid flows from the engine in the direction of the arrow 54 and after being warmed by the heater 10 is returned to the engine in the direction of the arrow 56.

At this time, attention is directed to a spoked yoke 60 which includes a ring 62 having an unthreaded bore 64 and a plurality (actually four) of rods 66 that extend radially from the ring 62. More specifically, the inner ends of the rods or spokes 66 are welded to the ring 62 at 68 whereas the outer ends are welded to the inner wall 14 of the jacket unit 12 at 70.

Turning now to a description of the catalytic burner unit which has been denoted generally by the reference numeral 80, it will be observed from FIGS. 2 and 3 that it comprises a cage 82 which includes a lower circular end plate or disc 83 and an upper circular end plate or disc 84, each having a number of holes adjacent their outer edges. The holes accommodate end portions of a similar number of studs 86, actually six, that have threaded upper and lower ends which have nuts 88 threaded thereon, half of which bear against the upper faces of the plates 83 and 84 and other half bear against the lower faces of these plates 83 and 84.

The catalytic burner unit 80 also includes a conventional wick 92 that extends downwardly into a fuel feed tube 94, the tube 94 extending through a hole 95 formed in the plate 83; the tube 94 is held in place by brazing or welding 96. It should be explained at this point that the wick 92 should be located approximately one-half to three-quarters of the distance between the lower plate 83 and the upper plate 84 because the fumes that are generated during the operation of the catalytic burner unit 80 are relatively heavy and should not rise to the height of the wick 92.

Figure 5:
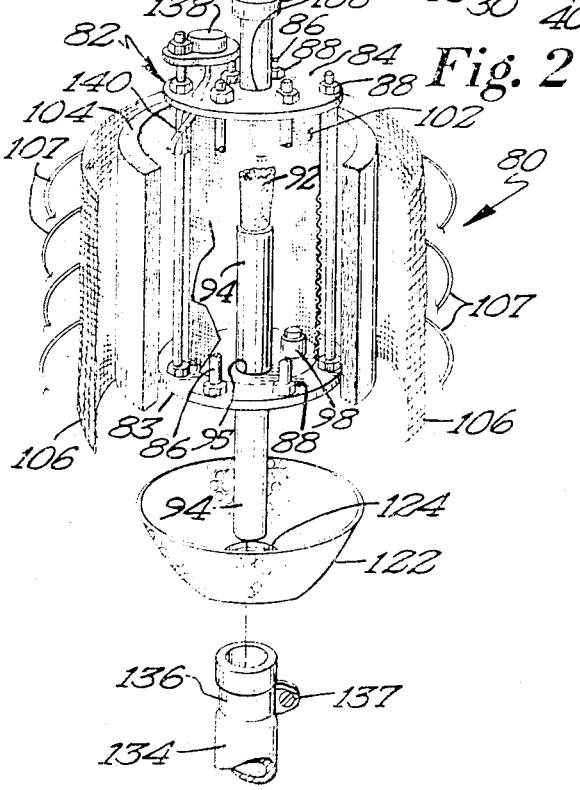
FIG. 5 is a diagrammatic view of my invention when using propane gas as the fuel.
Figure 5:
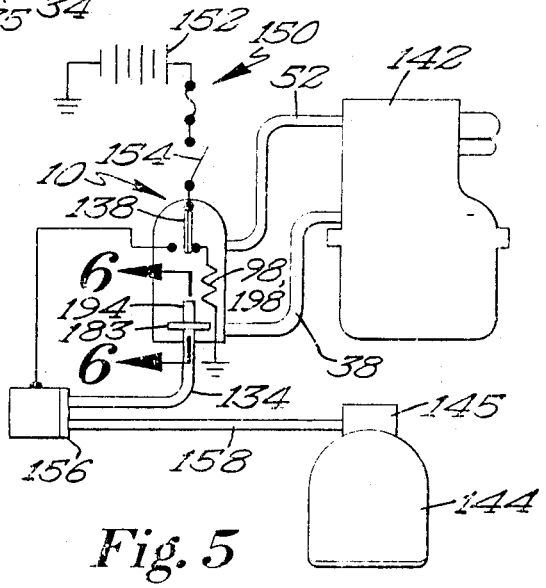

Although only one glow plug 98 has been depicted, it is advisable that two such plugs 98 be provided in case one burns out. With the single glow plug 98 that has been shown, there are two conductors 100 that the glow plug 98 in circuit with the vehicle's battery, as will be better appreciated when FIG. 5 is referred to.

Describing further the catalytic burner unit 80, it will be perceived from FIGS. 2 and 3 that there is a cylindrical screen 102 that is loosely held in place inside studs 86 and between the two plates 83 and 84. Screen 102 acts as a carburetor and distributes heat evenly inside of catalytic burner unit 80. It is important the screen 102 be fabricated from relatively light gauge wire so that it does not act as a heat sink, at least to the extent that it absorbs too much heat and thus unduly reduces the temperature of the catalytic burner unit 80. There is further a sleeve 104 formed of any insulating material that resists heat and which absorbs gas fumes and feeds the fumes evenly to a catalytic cloth 106. The catalytic cloth 106 functions as the burner material and can consist of various materials and may be comprised of a multiplicity of ceramic strands interspersed with a sufficient amount of platinum (or other appropriate metal) that provides the catalytic function needed to maintain the operation of the catalytic burner unit 80. During catalytic burning, catalytic cloth 106 will glow below the flaming point and will glow brighter with the addition of further fumes. However, if gasoline is poured on cloth 106, catalytic cloth 106 will smoke and go out. The catalytic cloth 106 has been shown as encircling the sleeve 104, thereby assisting in maintaining its cylindrical shape; however, a thin gauge wrapping wire 107 should additionally be used as long as it is fine enough not to act as a heat sink that would absorb a sufficient amount of heat so as to extinguish the catalytic burning that is required.

The upper plate 84 is provided with a hole at 108 allowing a mounting bolt 110 to extend upwardly therethrough. As can be seen from FIG. 3, the bolt 110 has a head 112 which is welded at 114 to the underside of the plate 84. The bolt 110 includes a shank 116, with a collar 118 affixed thereto intermediate the ends of the shank 116. The upper end labeled 120 is threaded.

Playing an important role in the achieving of an optimum burning action is a bottom perforated dome-shaped cap 122 having a central hole at 124 via which the feed tube 94 extends. The tube 94 is attached to the lower plate 83 by the brazing or welding 96. Corresponding to the perforated bottom cap 122 is a perforated upper dome-shaped cap 126 having a centrally located hole 128. The bolt 110, more specifically, its threaded upper end 120, projects upwardly through the hole 128. The threaded end 120 also extends through a washer 130. Through the agency of a nut 132 threadedly attached to the end 120, the cage 82 is pulled upwardly, the collar 118 engaging the lower side of the ring 62 belonging to the spoked yoke 60. In this way, the overlying cap 126 is clamped in place against the upper end of the jacket unit 12.

A flexible hose 134 delivers fuel to the feed tube 94 and is attached to the lower end of the feed tube 94 by means of a hose clamp 136 having a screw 137 that when tightened retains the upper end of the hose 134 in a fluid-type relation with the lower end of the feed tube 94. The clamping of the hose 134 is accomplished after the lower perforated cap 122 is positioned so as to underlie the jacket unit 12, as can be readily understood from FIG. 3. It will be appreciated that the catalytic burner unit 80 is suspended within the cavity 22 by reason of the bolt 110 and the nut 132. Perforated cap 122 can be held in place by spot welding to tube 94, by providing a small hose clamp on tube 94 under cap 122, or by having hose 134 abut with perforated cap 122.

Inasmuch as the collar 118 on the bolt 110 is intended to position the cage 82 and hence the entire burner unit 80 at the proper height within the cavity 22, it should be appreciated that the assembly of the heater 10 is completed by merely tightening the nut 132 after the perforated cap 126 has been placed on the top of the jacket unit 12 with the threaded end 120 of the bolt 110 projecting upwardly therethrough. In this way, if the catalytic burner unit 80 needs to be replaced or one of a different design substituted therefor, this can readily be done. Consequently, not only is the initial assembly of the heater 10 easily accomplished, but any replacement of the catalytic unit 80 can likewise be easily achieved.

Although it will be more fully dealt with hereinafter, at this time it will be noted that a thermostatic switch 138 is mounted on the upper side of the upper plate 84, there being a pair of conductors or wires 140 in circuit with this switch 138. Actually, the switch 138 constitutes a simple bimetallic switch.

Figure 4:
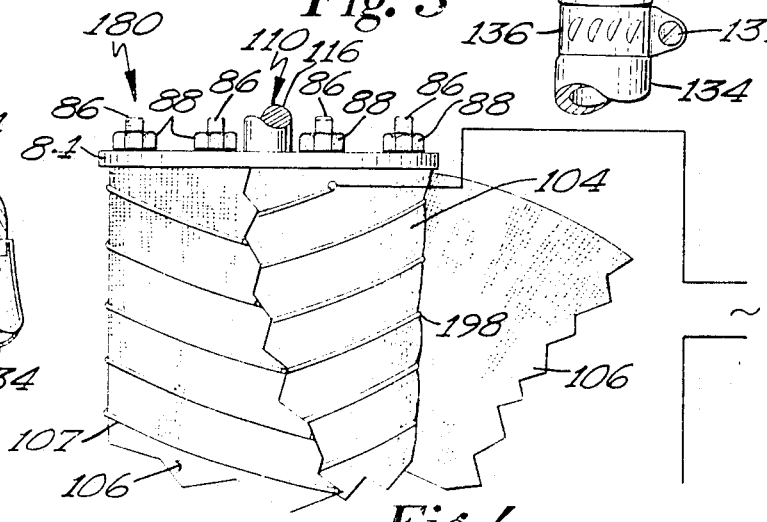
FIG. 4 illustrates a modified form of my invention, the fragmentarily depicted embodiment in this instance making use of a heating wire in contradistinction to the glow plug shown in FIGS. 2 and 3.

Whereas the catalytic burner unit 80 appearing in the embodiment of FIGS. 1–3 makes use of a glow plug 98, preferably two such plugs in parallel, a modified catalytic burner unit is identified by the reference numeral 180 in FIG. 4. Instead of the glow plug 98, a nichrome heating wire 198 is used in initiating the catalytic action. As with the catalytic unit 80, a lightweight wire, such as the wire 107, is intended to be used in maintaining the shape of the sleeve 104.

Figure 6:
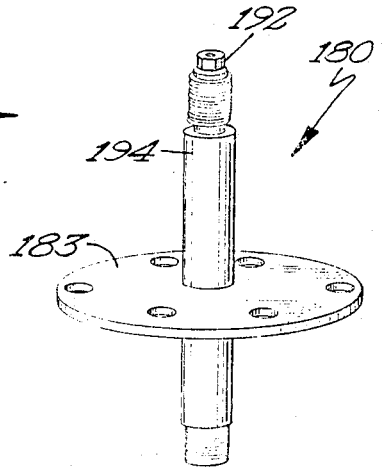
FIG. 6 is a perspective detail showing the feed tube and nozzle utilized in FIG. 5, the view being an enlargement of what is indicated by the directional arrows 6—6.

It is planned that my heater 10 be operable with propane gas. With this in mind, reference will now be made to FIG. 6 in which an end plate 183 corresponding to the end plate 83 is shown. Instead of the wick 92, there is a propane nozzle 192 at the upper end of a feed tube 194. Since the feed tube 94 in the embodiment of FIGS. 1–3 is fixedly attached to a lower plate 83 through which it extends, what appears in FIG. 6 constitutes a simple assembly that can be used to replace very readily the assembly shown in FIGS. 2 and 3 involving the lower plate 83 and the feed tube 94 that is fixedly attached thereto by virtue of the brazing or welding 96.

Reference has hereinbefore been made to Pat. No. 3,501,257, the present applicant being one of the patentees, so it can be explained that the connection of the heater 10 with respect to the block of an internal combustion engine is the same as depicted in my said patent. More specifically, the hoses 38 and 52, even though only fragmentarily illustrated in FIG. 2 are connected to the engine block in the same manner as in my said patent.

Inasmuch as the present invention is adaptable to being fueled with propane gas, it may be helpful to briefly describe what is diagrammatically presented in FIG. 5. With this in mind, an internal combustion engine 142 is shown in FIG. 5 along with a propane tank 144 having a pressure regulator 145 associated therewith. The electrical circuit 150 includes the vehicle's battery 152 plus a manually actuated switch 154 that must first be closed in order to supply current to a solenoid valve 156 via the previously mentioned thermostatic switch 138. Switch 154 is mounted on the dash of the vehicle. The electrical circuit 150 may include a fuse between battery 152 and switch 154. The thermostatic 138, more specifically a bimetallic type of switch, is normally closed. Of course, the switch 138 is ineffectual when the switch 154 is left open, which is the case whenever the ambient temperature is sufficiently high so as not to require auxillary heating from the heater 10. The solenoid valve 156 is communicatively connected to the propane tank 144 by means of a tube 158. It will be observed that the means for heating and thus getting the heater 10 functioning can be in the form of a glow plug 98 or the nichrome heating wire 198. What has been depicted in FIG. 5 is intended to be generic to both of these means. Hence, the two reference numerals 98 and 198 have been applied to the heating element which appears as a conventional resistor in FIG. 5.

Consequently, whenever the ambient temperature is quite low, the operator of the vehicle having the components of FIG. 5 installed thereon would close the switch 154 after parking the vehicle with the consequence that the vehicle's battery 152 will supply energizing current through the element 98 or 198, as the case may be, so as to initiate the catalytic burning action. The thermostatic switch 138 will automatically open when a sufficient elevated temperature is reached, preferably in the neighborhood of 340° F. Additionally, when propane is utilized as fuel, thermostatic switch 138 is a double bimetal switch such that when the elevated temperature is reached, one side of the switch 138 will open to shut off current to the element 98 or 198, as the case may be, while the other side closes to supply energizing current to the solenoid valve 156 which opens to allow flow of propane. Once this temperature is reached, however, the catalytic action is self-sustaining until the switch 154 is opened by the operator, which would be when the ambient or atmospheric temperature is sufficiently high so that auxillary heating of the liquid in the vehicle's cooling system is no longer needed. A small check valve may be provided in the gas line leading to heater 10 in the event that the operator forgets to open switch 154 when the vehicle is being operated and/or driven.

Actually, the heater 10 will be supplied mainly from the fuel tank of the vehicle rather than utilizing the propane tank 144. It should be appreciated that only a relatively small amount of fuel will be consumed, actually on the order of only one ounce per hour. Even this can be regulated by raising or lowering the wick 92.

It may be helpful in appreciating the benefits to be derived from my invention to explain more fully the function of the perforated caps 122 and 126. By virtue of the small holes in these caps 122, 126, there is provided a protection against wind conditions of sufficient velocity that would cause burn-out or extinguishment of the catalytic action. A burn-out situation would cause the thermostatic switch 138 to close and open repeatedly and this cycling would cause a current drain as far as the vehicle's battery 152 is concerned. Whereas a "chimney effect" is required as far as sustaining combustion in the burner unit 80. In this regard, air enters through the open bottom 23 and leaves through the open top 24 which serves as a vent for the heated air. Although a natural flow of air is needed, any excessive wind velocity would cause the above-mentioned burn-out to occur. However, the small holes or perforations in the caps 122 and 126 act as orifices which break up any rapid flow of air so that the extinguishing of the burner unit 80 does not take place. It might be emphasized at this stage that one of the features of my invention is the simplicity of its construction. However, simplicity without the caps 122 and 126 would not assure a continuous burning operation.

Figure 7:
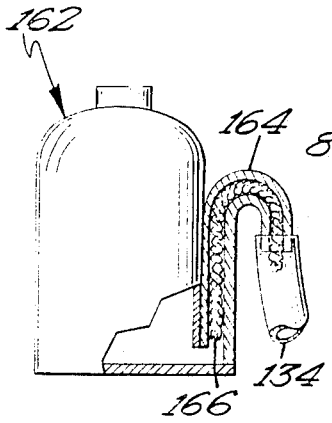
FIG. 7 illustrates an auxiliary tank which may be utilized with the heater of my invention.

Inasmuch as it is intended that my invention possess a considerable amount of versatility, it is intended that the heater 10 will also find usefulness when used in conjunction with diesel engines. Therefore, an auxillary tank 162 is shown in FIG. 7. It will be observed that there is a U-shaped tube 164 at one side of the tank 162, the lower end of the tube 164 being in communication with the bottom of the tank 162. The tube 164, which is shown only in cross section, contains therein a wick 166 which causes the tube 164 to function as a spout that will only drip gasoline from the tank 162 into the hose 134 which in this instance would extend from the upper end of the tube 164 to the feed tube 94.

What has been illustrated in FIG. 7 avoids an adverse situation that would likely arise where the tank 162, being portable, would be located at a higher elevation than the heater 10. Without the wick 166, flooding of the heater 10 would occur owing to its lower elevation.

In general, my invention contemplates the connection 5 of my heater 10 to the gasoline tank of a vehicle, or a portable tank, such as the tank 162 shown in FIG. 7. It is believed that the largest market for heater 10 will be diesel engines. In the case of over-the-road diesel trucks, a large space on the right side behind the cab and inside the frame is typically available to mount heater 10 while on the left side behind the cab and on the frame, a propane tank 144 or an auxiliary tank 162 may be mounted. It can be appreciated that most service stations have propane fuel for refilling propane tank 144.

It can also be appreciated that heater 10 according to my invention may be connected to the engine's cooling system by quick coupling to allow portable use. Portable use is believed to be particularly advantageous for use on logging equipment, bulldozers, road equipment, and the like.

It is to be understood that suitable modifications may be made in the structure that has been herein disclosed, provided that such modifications come within the spirit and scope of the appended claims.

What is claimed is:

1. A heater for internal combustion engines comprising a jacket unit forming a central cavity having lower and upper openings, a catalytic burner unit, said catalytic burner unit including a cage comprising lower and upper plates and a plurality of threaded studs maintaining said plates in a vertically spaced relation, and means extending from said catalytic burner unit through said upper opening for suspending said burner unit within said cavity.

2. A heater in accordance with claim 1 in which said suspending means includes a bolt extending upwardly from said catalytic burner unit, a perforated member overlying the upper end of said jacket unit, said perforated member having a hole therein through which said bolt extends, and a nut on the upper end of said bolt.

3. A heater in accordance with claim 2 in which said catalytic burner unit includes a downwardly extending feed tube, and a second perforated member underlying the lower end of said jacket unit, said second perforated member having a hole therein through which said feed tube extends.

4. A heater in accordance with claim 3 in which each of said perforated members is dome-shaped.

5. A heater in accordance with claim 3 including a wick projecting upwardly from the upper end of said feed tube.

6. A heater in accordance with claim 3 including a propane nozzle at the upper end of said feed tube.

7. A heater in accordance with claim 1 in which said suspension means has its lower end attached to said upper plate.

8. A heater in accordance with claim 7 including a yoke comprising a ring and a plurality of rods extending radially from said ring with the outer ends of said rods being secured to the interior of said jacket unit.

9. A heater in accordance with claim 8 in which said suspension means includes a bolt having its lower end attached to said upper plate, a perforated member having a hole therein through which said bolt extends, and a nut on the upper end of said bolt.

10. A heater in accordance with claim 9 including a feed tube extending upwardly and downwardly from said lower plate, and a second perforated member underlying said jacket unit through which said feed tube extends.

11. A heater in accordance with claim 10 including a sleeve of catalytic material having its lower end engaging said lower plate and its upper end engaging said upper plate.

12. A heater in accordance with claim 11 including a glow plug for initiating a catalytic burning action.

13. A heater in accordance with claim 11 including a heating wire encircling said sleeve for initiating a catalytic burning action.

14. A heater for internal combustion engines comprising a jacket unit forming a cavity having bottom and top openings, a catalytic burner unit disposed in said cavity, a bolt extending upwardly from said catalytic burner unit having a threaded upper end, a perforated dome-shaped cap overlying the upper end of said jacket unit having a hole therein through which said bolt extends, a nut on the threaded end of said bolt for clamping said perforated cap in its overlying position and at the same time suspending said catalytic burner unit within said cavity, a feed tube extending downwardly from said catalytic burner unit, a second perforated dome-shaped cap underlying the lower end of said jacket unit having a hole therein through which said feed tube extends, and a flexible hose connected to the lower end of said feed tube, the upper end of said hose engaging the underside of said second dome-shaped cap for holding the second dome-shaped cap in place on the jacket unit.

* * * * *

UNITED STATES PATENT OFFICE

CERTIFICATE OF CORRECTION

Patent No. 4,964,797 Dated October 23, 1990

Inventor(s) Chester W. Hilton

It is certified that error appears in the above-identified patent and that said Letters Patent is hereby corrected as shown below:

Column 6, line 53, cancel "5".

Column 7, lines 13 and 14, cancel "through said upper opening".

Signed and Sealed this

Twenty-fifth Day of February, 1992

*Attest:*

HARRY F. MANBECK, JR.

*Attesting Officer*

*Commissioner of Patents and Trademarks*